US008564520B2

(12) United States Patent
Choi et al.

(10) Patent No.: US 8,564,520 B2
(45) Date of Patent: Oct. 22, 2013

(54) METHOD FOR DRIVING A DISPLAY PANEL AND DISPLAY APPARATUS FOR PERFORMING THE METHOD

(75) Inventors: Uk-Chul Choi, Cheonan-si (KR); Nak-Cho Choi, Seoul (KR); Sung-Woon Kim, Suwon-si (KR)

(73) Assignee: Samsung Display Co., Ltd. (KR)

( * ) Notice: Subject to any disclaimer, the term of this patent is extended or adjusted under 35 U.S.C. 154(b) by 922 days.

(21) Appl. No.: 12/559,650

(22) Filed: Sep. 15, 2009

(65) Prior Publication Data

US 2010/0277406 A1 Nov. 4, 2010

(30) Foreign Application Priority Data

Apr. 29, 2009 (KR) ..... 2009-0037490

(51) Int. Cl.
*G09G 3/36* (2006.01)

(52) U.S. Cl.
USPC ..... 345/94

(58) Field of Classification Search
None
See application file for complete search history.

(56) References Cited

U.S. PATENT DOCUMENTS 6,151,004 A * 11/2000 Kaneko ..... 345/88
2010/0225569 A1* 9/2010 Park et al. ..... 345/87

* cited by examiner

*Primary Examiner* — Daniell L Negron
(74) *Attorney, Agent, or Firm* — Cantor Colburn LLP

(57) ABSTRACT

A method for driving a display panel, the display panel including a plurality of pixels, each of the plurality of pixels including a cholesteric liquid crystal capacitor, includes; applying a common voltage to the display panel, displaying a video on the display panel by applying a data voltage to at least one of the plurality of pixels, the data voltage having a phase which is one of inverted to and substantially the same as a phase of the common voltage with respect to a reference voltage.

19 Claims, 11 Drawing Sheets

HOMEOTROPIC
$E > E_c$

PLANAR STATE
$E < E_F$

METHOD FOR DRIVING A DISPLAY PANEL AND DISPLAY APPARATUS FOR PERFORMING THE METHOD

This application claims priority to Korean Patent Application No. 2009-37490, filed on Apr. 29, 2009, the content of which in its entirety is herein incorporated by reference.

BACKGROUND OF THE INVENTION

1. Field of the Invention

Exemplary embodiments relate to a method for driving a display panel, and a display apparatus for performing the method for driving the display panel. More particularly, exemplary embodiments relate to a method for driving a display panel having cholesteric liquid crystal, and a display apparatus for performing the method for driving the display panel including cholesteric liquid crystal.

2. Description of the Related Art

Generally, a typical liquid crystal has regularly arranged molecules and fluidity similar to that of a liquid. In addition liquid crystal molecules have various optical characteristics according to an arrangement direction thereof.

The typical liquid crystal has long and narrow molecules, e.g., molecules shaped like a rod. The arrangement of the molecules is changed or the motion of the molecules may be scattered by an electric field, a magnetic field, heat, etc. from an outside controller. Therefore, the optical characteristics of the liquid crystal may be easily changed.

The liquid crystal may be classified into different types of liquid crystal such as nematic liquid crystal or cholesteric liquid crystal according to the arrangement of the molecules therein. The arrangement, e.g., positioning, of the molecules in the nematic liquid crystal is irregular but the molecular axis of the nematic liquid crystals is commonly oriented in a particular direction. The direction of the axis alignment of molecules arranged in an upper portion of the liquid crystal is substantially the same as that in a lower portion of the liquid crystal so that polarization is offset in both directions. Thus, the nematic liquid crystal does not have ferroelectricity. The cholesteric liquid crystal has a layer structure having a plurality of layers, and the arrangement of the molecules in each of the layers is similar to the arrangement of nematic liquid crystal, e.g., the positional relationships of liquid crystal molecules within a single layer is irregular, but the axis alignment of the molecules is common to the layer. Each of the layers is typically very thin. The arrangement of the molecules in each layer is directed in a longitudinal axis, and surfaces of the layers are parallel with, e.g., normal to, each other. The longitudinal axis of each of the layers is a little different from the longitudinal axis of adjacent layer, so that the arrangement of the molecules in the cholesteric liquid crystal is typical of a spiral nature.

FIGS. 1A, 1B and 1C are schematic diagrams illustrating a state change of cholesteric liquid crystal according to the intensity of an electric field applied thereto.

Referring to FIG. 1A, when an electric field E applied to the cholesteric liquid crystal is greater than a first electric field $E_C$, the cholesteric liquid crystal is arranged to be in a homeotropic state. Referring to FIG. 1B, when the electric field E becomes less than a second electric field $E_F$ in the homeotropic state, the cholesteric liquid crystal is arranged to be a planar state. Referring to FIG. 1C, when the electric field E is greater than the first electric field $E_C$ and less than the second electric field $E_F$ in the homeotropic state, the cholesteric liquid crystal is arranged to be a focal conic state. The cholesteric liquid crystal in the planar state reflects light having a specific wavelength, and the cholesteric liquid crystal in the focal conic state scatters the light.

The cholesteric type of liquid crystal is gaining in popularity as a new medium for a reflective display apparatus, but has a relatively slower transition period with respect to the electrical field applied thereto. Thus, the typical cholesteric liquid crystal is not suitable for displaying rapidly changing display states, e.g., a video.

BRIEF SUMMARY OF THE INVENTION

Exemplary embodiments of the present invention provide a method for driving a display panel having cholesteric liquid crystal.

Exemplary embodiments of the present invention also provide a display apparatus for performing the method for driving the display panel.

According to one exemplary embodiment of the present invention, a method for driving a display panel, the display panel including a plurality of pixels, each of the plurality of pixels including a cholesteric liquid crystal capacitor, includes: applying a common voltage to the display panel, and displaying a video on the display panel by applying a data voltage to at least one of the plurality of pixels, the data voltage having a phase which is one of inverted to and substantially the same as a phase of the common voltage with respect to a reference voltage, wherein the displaying a video on the display panel further comprises sequentially applying a plurality of gate signals to a plurality of gate lines, the plurality of gate lines being disposed on the display panel and applying the data voltage having the phase which is one of inverted to and substantially the same as the phase of the common voltage to at least one of a plurality of data lines disposed on the display panel, to display one of a black image and a color image.

According to another exemplary embodiment of the present invention, a display apparatus includes; a display panel including a plurality of pixels, each of the plurality of pixels including a cholesteric liquid crystal capacitor, and a panel driving part which applies a common voltage to the display panel, and displays a video on the display panel by application of a data voltage to at least one of the plurality of pixels, the data voltage having a phase which is one of inverted to and substantially the same as a phase of the common voltage with respect to a reference voltage.

According to the present invention, the video may be displayed using the homeotropic state and the planar state of the cholesteric liquid crystal, and thus costs of a reflective display apparatus may be reduced.

BRIEF DESCRIPTION OF THE DRAWINGS

The above and other features and advantages of the present invention will become more apparent by describing in detailed example embodiments thereof with reference to the accompanying drawings, in which.

DETAILED DESCRIPTION OF THE INVENTION

Figure 1A:
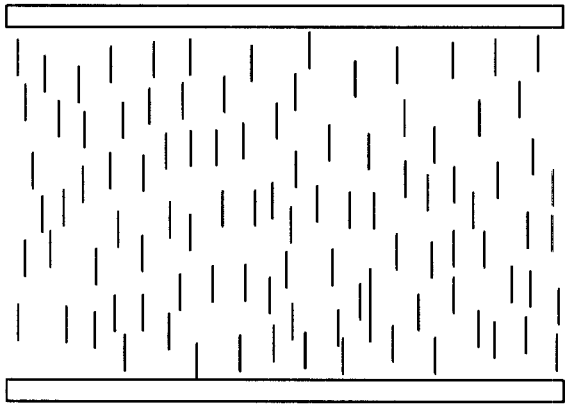
FIGS. 1A, 1B and 1C are schematic diagrams illustrating a state change of typical cholesteric liquid crystal molecules according to an intensity of an electric field applied thereto.
Figure 1B:
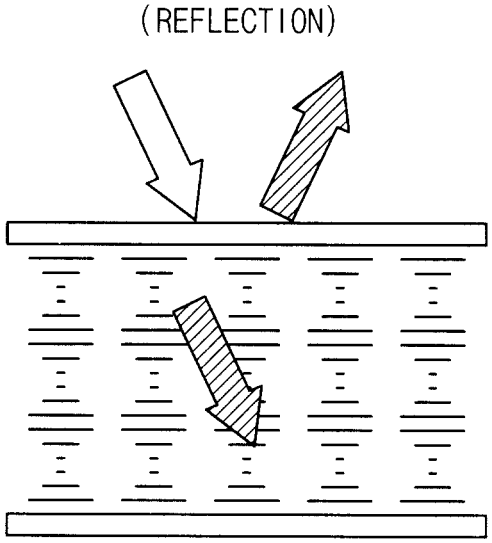
Figure 1C:
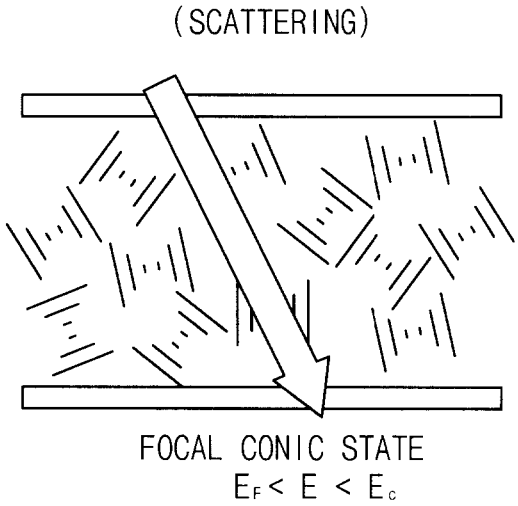

The present invention now will be described more fully hereinafter with reference to the accompanying drawings, in which exemplary embodiments of the present invention are shown. The present invention may, however, be embodied in many different forms and should not be construed as limited to the exemplary embodiments set forth herein. Rather, these exemplary embodiments are provided so that this disclosure will be thorough and complete, and will fully convey the scope of the present invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the apparatus in use or operation in addition to the orientation depicted in the figures. For example, if the apparatus in the figures is turned over, elements described as "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein interpreted accordingly.

The terminology used herein is for the purpose of describing particular example embodiments only and is not intended to be limiting of the present invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Exemplary embodiments of the invention are described herein with reference to cross-sectional illustrations that are schematic illustrations of idealized example embodiments (and intermediate structures) of the present invention. As such, variations from the shapes of the illustrations as a result, for example, of manufacturing techniques and/or tolerances, are to be expected. Thus, example embodiments of the present invention should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of an apparatus and are not intended to limit the scope of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, the present invention will be explained in detail with reference to the accompanying drawings.

Figure 2:
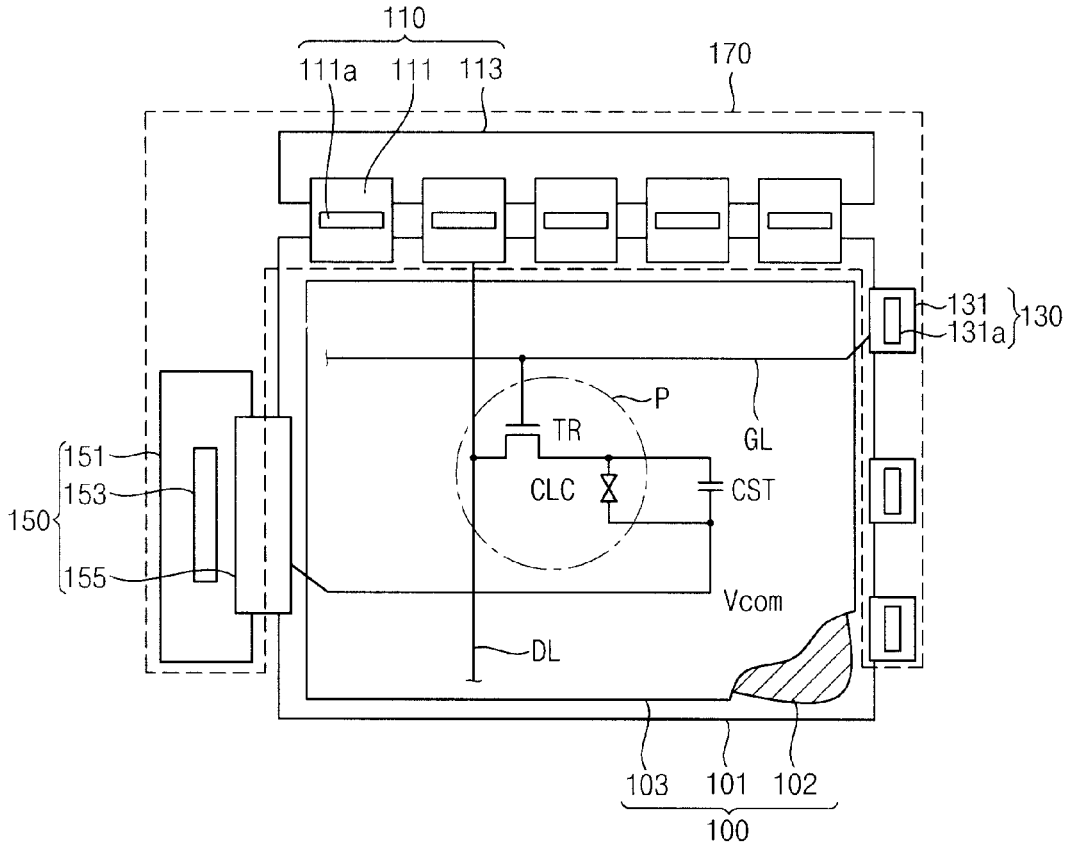
FIG. 2 is a block diagram illustrating an exemplary embodiment of a display device according to the present invention.
Figure 3:
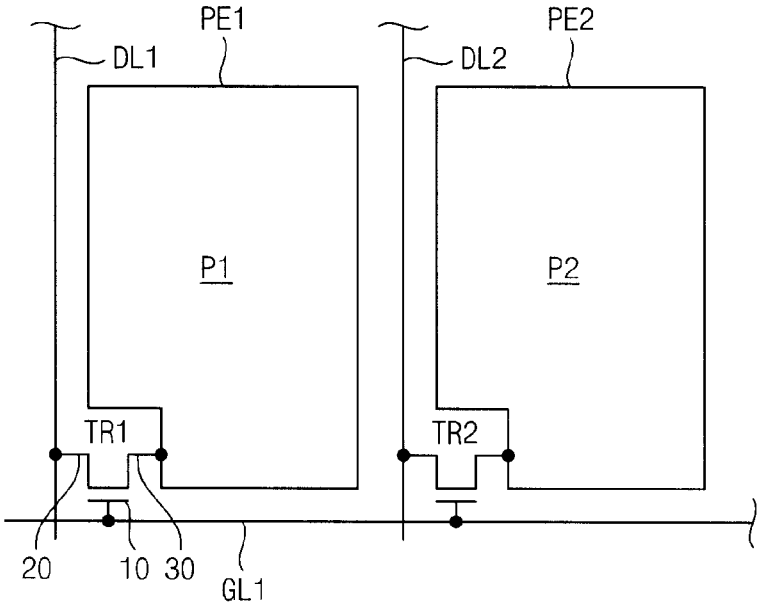
FIG. 3 is a schematic diagram illustrating a magnified view of an exemplary embodiment of a display substrate according to an exemplary embodiment of the display panel of FIG. 2.
Figure 4:
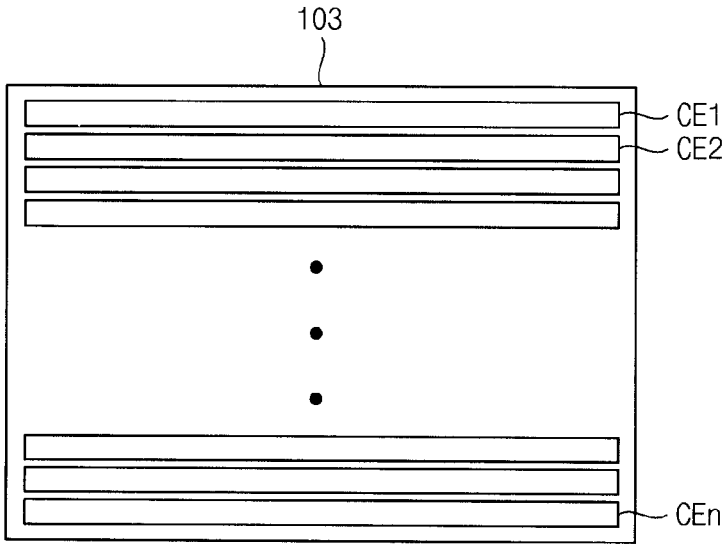
FIG. 4 is a top plan view illustrating an exemplary embodiment of an opposing substrate of the exemplary embodiment of a display panel of FIG. 2.

FIG. 2 is a block diagram illustrating an exemplary embodiment of a display device according to the present invention. FIG. 3 is a schematic diagram illustrating an exemplary embodiment of a display substrate according to the exemplary embodiment of a display panel of FIG. 2. FIG. 4 is a top plan view illustrating an exemplary embodiment of the opposing substrate of FIG. 2.

Referring to FIG. 2, the display apparatus includes a display panel 100 which may be used for displaying an image and a panel driving part 170 driving the display panel 100.

The display panel 100 includes a display substrate 101, cholesteric liquid crystal layer 102 and an opposing substrate 103.

The display panel 100 includes a plurality of data lines DL, only one of which is illustrated in order to simplify the illustration, a plurality of gate lines GL, only one of which is illustrated in order to simplify the illustration, disposed substantially perpendicular to the plurality of data lines DL, and a plurality of pixels P. Each pixel P of the plurality of pixels includes a switching element TR connected to a data line DL and a gate line GL, a cholesteric liquid crystal capacitor CLC connected to the switching element TR, and a storage capacitor CST connected to the cholesteric liquid crystal capacitor CLC.

When the cholesteric liquid crystal capacitor CLC is charged with a maximum voltage, the cholesteric liquid crystal is arranged to be in a homeotropic state to display a black image. When the cholesteric liquid crystal capacitor CLC is charged with a minimum voltage, the cholesteric liquid crystal is arranged to be a planar state to display a color image. The storage capacitor CST holds a voltage charged in the cholesteric liquid crystal capacitor CLC for one frame. Generally, a color may be changed according to the wavelength of light reflected from the cholesteric liquid crystal layer 102. The wavelength of the reflected light is based on the pitch of the cholesteric liquid crystal, e.g., the degree of rotation of the axis of alignment of the cholesteric liquid crystal molecules from one layer to the next. The pitch of the cholesteric liquid crystal may be changed according to the amount of a chiral dopant included in the cholesteric liquid crystal. Therefore, the colors in the planar state may include various colors, such as green, red, blue, etc., to be displayed in full color.

The display panel 100 may display a video using the homeotropic state and the planar state of the cholesteric liquid crystal. Additionally, the display panel 100 may display a still image using the planar state and the focal conic state.

The display substrate 101 as shown in FIG. 3, includes a plurality of pixels P1 and P2. A first pixel P1 includes a first switching element TR1 and a first pixel electrode PE1. The first switching element TR1 includes a gate electrode 10 connected to a first gate line GL1, source electrode 20 connected to a first data line DL and a drain electrode 30 connected to the first pixel electrode PE1. A second pixel P2 includes a second switching element TR2 and a second pixel electrode PE2. A storage capacitor CST (not shown) stores a charged voltage in the cholesteric liquid crystal capacitor CLC for a period of at least a frame.

The first pixel electrode PE1 corresponds to a first electrode of the cholesteric liquid crystal capacitor CLC, and receives a data voltage transmitted from the first data line DL1.

The opposing substrate 103 as shown in FIG. 4, includes a plurality of sub-common electrodes CE1, CE2, . . . , Cen, wherein 'n' is a natural number. The sub-common electrodes CE1, CE2, . . . , CEn are spaced apart from each other and are disposed substantially in parallel with the gate lines GL. For example, in one exemplary embodiment a first sub-common electrode CE1 is overlapped, e.g., vertically aligned, with the pixel electrodes P1 and P2 that are arranged in a direction of extension of the first gate line GL1. The first sub-common electrode CE1 corresponds to a second electrode of the cholesteric liquid crystal capacitor CLC. The cholesteric liquid crystal capacitor CLC of the first pixel includes the first pixel electrode PE1, the first sub-common electrode CE1 and the cholesteric liquid crystal layer 102.

The panel driving part 170 includes a data driving part 110, a gate driving part 130, and a common voltage driving part 150.

The data driving part 110 includes a first flexible printed circuit board ("FPCB") 111 and a printed circuit board ("PCB") 113. The first FPCB 111 includes a data driving circuit 111*a* and is electrically connected to the display panel 100. The data driving circuit 111*a* generates a data voltage, and applies the data voltage to at least one of the data lines DL of the display panel 100 via the first FPCB 111.

The gate driving part 130 includes a second FPCB 131. The second FPCB 131 includes a gate driving circuit 131*a*, and is electrically connected to the display panel 100. The gate driving circuit 131*a* generates a gate signal, and applies the gate signal to at least one of the gate line GL of the display panel 100 via the second FPCB 131.

The common voltage driving part 150 includes a PCB 151, a common voltage driving circuit 153 and an FPCB 155. The PCB 151 includes the common voltage driving circuit 153, and is electrically connected to the display panel 100 via the FPCB 155. The common voltage driving circuit 153 sequentially applies a common voltage Vcom to the sub-common electrodes CE1, CE2, . . . , CEn. The common voltage driving circuit 153 generates the common voltage Vcom having a polarity that is inverted after a frame period has elapsed, e.g., the polarity is inverted for each subsequent frame. For example, in one exemplary embodiment the common voltage driving circuit 153 sequentially applies a common voltage+Vcom of a positive polarity (+) to the sub-common electrodes CE1, CE2, . . . , CEn in a first frame, and sequentially applies a common voltage−Vcom of a negative polarity (−) to the sub-common electrodes CE1, CE2, . . . , CEn in a second frame. In one exemplary embodiment a potential difference greater than or equal to about 20 V may be used to drive the cholesteric liquid crystal layer 102. Accordingly, the common voltage Vcom may have a difference of about 20 V from the data voltage.

Figure 5:
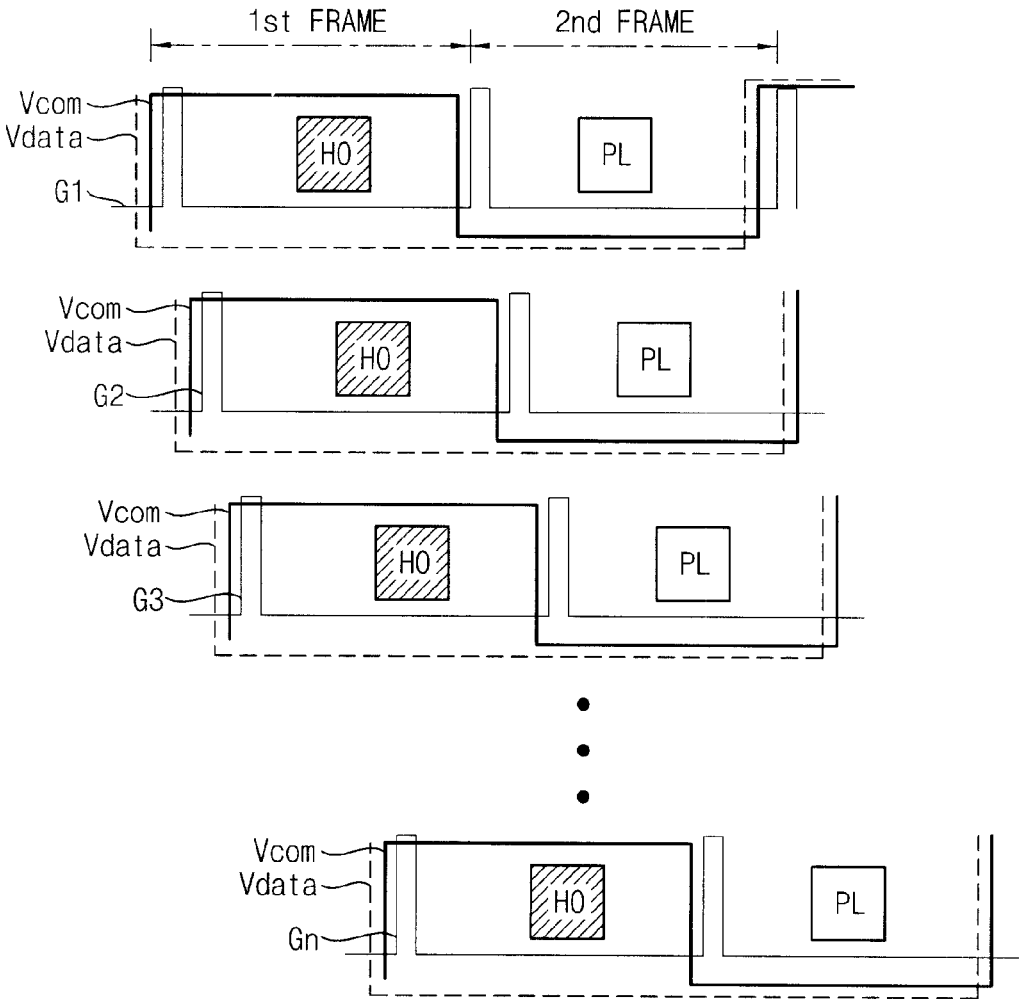
FIG. 5 is a waveform diagram illustrating an exemplary embodiment of a method for driving the exemplary embodiment of a display panel of FIG. 2.

FIG. 5 is a waveform diagram illustrating an exemplary embodiment of a method for driving the display panel of FIG. 2.

Referring to FIGS. 2, 3, 4 and 5, the data driving part 110 outputs a data voltage Vdata of the negative polarity (−) corresponding to the pixels of a first pixel row to each of the data lines DL in a 1 horizontal period (H). The gate driving part 130 outputs a first gate signal G1 to the first gate line GL1 based on an output timing of the data driving part 110. The common voltage driving part 150 outputs the common voltage Vcom of the positive polarity (+) to the first sub-common electrode CE1 based on the first gate signal G1. Therefore, the pixels of the first pixel row receive the data voltage Vdata having the negative polarity (−) and the common voltage Vcom having the positive polarity (+) so that the cholesteric liquid crystal is arranged in the homeotropic state by a voltage difference between the data voltage Vdata and the common voltage Vcom. Thus, the pixels of the first pixel row display a black image.

Additionally, the data driving part 110 outputs a data voltage Vdata having the negative polarity (−) corresponding to the pixels of a second pixel row, e.g., a row corresponding to a second gate line GL2, to each of the data lines DL in a 1 horizontal period (H). The gate driving part 130 outputs a second gate signal G2 to the second gate line GL2 based on an output timing of the data driving part 110. The common voltage driving part 150 outputs the common voltage Vcom having the positive polarity (+) to the second sub-common electrode CE2 based on the second gate signal G2.

The common voltage driving part 150 sequentially outputs the common voltage Vcom having the positive polarity (+) to the sub-common electrodes CE1, CE2, . . . , CEn based on a plurality of gate signals G1, G2, . . . , Gn sequentially outputted in the first frame period (e.g., during a first frame, hereinafter "1st FRAME").

However, the common voltage driving part 150 sequentially outputs the common voltage Vcom having the negative polarity (−) to the sub-common electrodes CE1, CE2, . . . , CEn based on a plurality of gate signals G1, G2, . . . , Gn sequentially outputted in a second frame period (e.g., during a second frame, hereinafter "2nd FRAME"). For example, the data driving part 110 outputs a data voltage Vdata having the negative polarity (−) corresponding to the pixels of the first pixel row corresponding to the gate line GL1 to each of the data lines DL in the 1 horizontal period (H). The gate driving part 130 outputs a first gate signal G1 to the first gate line GL1 based on an output timing of the data driving part 110. The common voltage driving part 150 outputs the common voltage Vcom of the negative polarity (−) to the first sub-common electrode CE1 based on the first gate signal G1. Therefore, the pixels of the first pixel row receive the data voltage Vdata of the negative polarity (−) and the common voltage Vcom of the negative polarity (−) so that the cholesteric liquid crystal is arranged in the planar state PL by a difference between the data voltage Vdata and the common voltage Vcom. Thus, the pixels of the first pixel row display a color image. For example, in one exemplary embodiment the color image may be a green image. Additionally, exemplary embodiments include configurations wherein the color image may include various colors, such as green, red, blue, etc., to be displayed in full color.

Thus, as illustrated in FIG. 5, the $1^{st}$ FRAME displays a black image and the $2^{nd}$ FRAME displays a color image.

Figure 6:
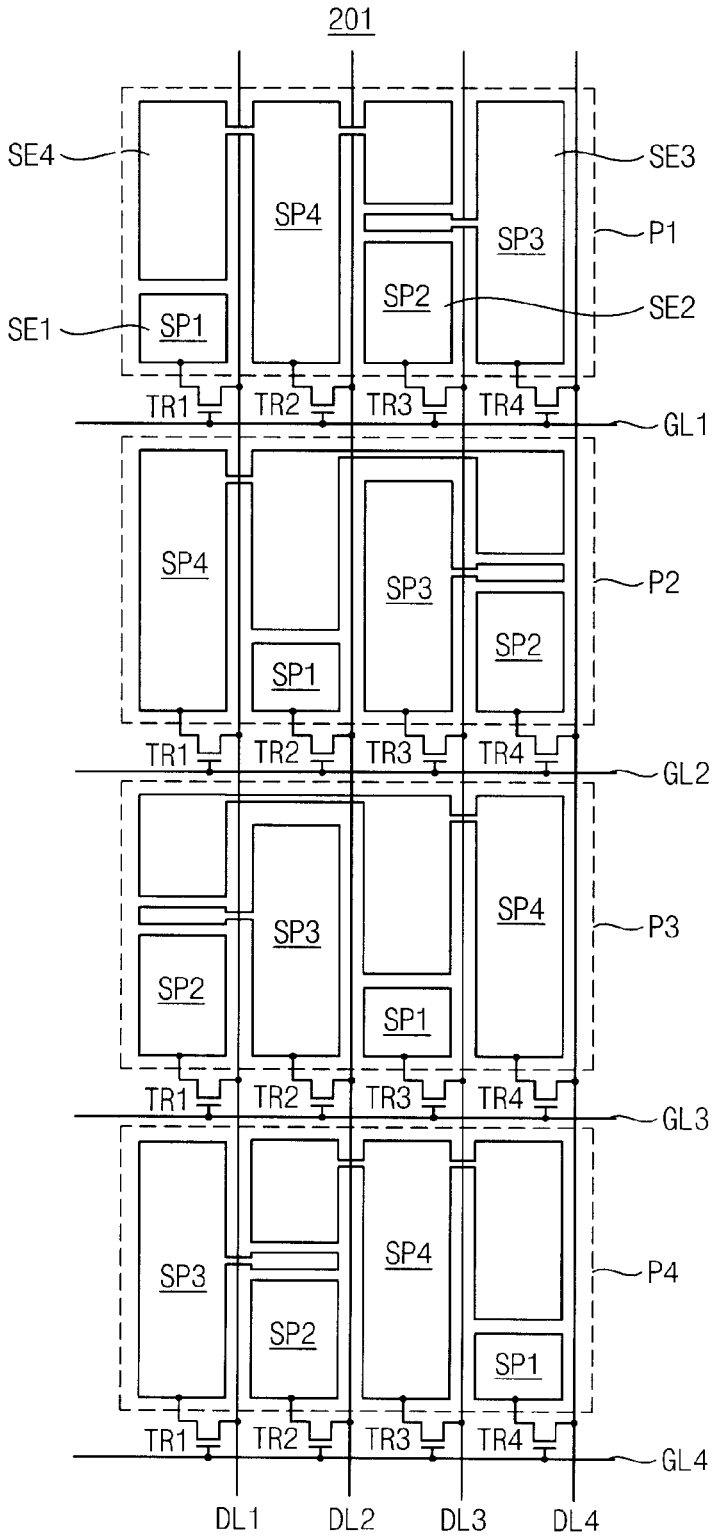
FIG. 6 is a schematic diagram illustrating another exemplary embodiment of a display substrate according to another exemplary embodiment of the display panel of FIG. 2.

FIG. 6 is a schematic diagram illustrating another exemplary embodiment of a display substrate according to an exemplary embodiment of the display panel of FIG. 2.

Referring to FIG. 6, the display substrate 201 includes a plurality of data lines DL1, DL2, DL3 and DL4, a plurality of gate lines GL1, GL2, GL3 and GL4 disposed substantially perpendicular to the data lines DL1, DL2, DL3 and DL4 and a plurality of pixels P1, P2, P3 and P4. The pixels P1, P2, P3 and P4 are arranged in a direction of extension of the data lines DL1, DL2, DL3 and DL4.

The first pixel P1 comprises a first sub-pixel SP1, a second sub-pixel SP2, a third sub-pixel SP3 and a fourth sub-pixel SP4. The first sub-pixel SP1 includes a first switching element TR1 connected to a first data line DL1 and a first gate line GL1, and a first sub-pixel electrode SE1 connected to the first switching element TR1. The fourth sub-pixel SP4 includes a second switching element TR2 connected to a second data line DL2 and the first gate line GL1 and a fourth sub-pixel electrode SE4 connected to the second switching element TR2. The second sub-pixel SP2 includes a third switching element TR3 connected to a third data line DL3 and the first gate line GL1, and a second sub-pixel electrode SE2 connected to the third switching element TR3. The third sub-pixel SP3 includes a fourth switching element TR4 connected to a fourth data line DL4 and the first gate line GL1, and a third sub-pixel electrode SE3 connected to the fourth switching element TR4. The first, second, third and fourth sub-pixel electrodes SE1, SE2, SE3 and SE4 may substantially equal the areas of the first, second, third and fourth sub-pixels, respectively.

A pixel electrode of the first pixel P1 comprises the first, second, third and fourth sub-pixel electrodes SE1, SE2, SE3 and SE4. In the present exemplary embodiment, the sizes of the first, second, third and fourth sub-pixel electrodes SE1, SE2, SE3 and SE4 are different from each other. For example, in one exemplary embodiment the size ratio of the first, second, third and fourth sub-pixel electrodes SE1, SE2, SE3 and SE4 is about 1:2:4:8. The size ratio of the first, second, third and fourth sub-pixel electrodes SE1, SE2, SE3 and SE4 is substantially the same as the size ratio of the first, second, third and fourth sub-pixels SP1, SP2, SP3 and SP4.

A plurality of grayscale values of the first pixel P1 may be displayed corresponding to the activation of, e.g., the application of a voltage thereof sufficient to put the sub-pixel in a planar state, and the size ratio of, the first, second, third and fourth sub-pixels SP1, SP2, SP3 and SP4. The activation of the sub-pixels may be expressed according to the following Table 1.

TABLE 1

| Grayscale Value | SP1 (1) | SP2 (2) | SP3 (4) | SP4 (8) |
|---|---|---|---|---|
| 0 | 0 | 0 | 0 | 0 |
| 1 | 1 | 0 | 0 | 0 |
| 2 | 0 | 1 | 0 | 0 |
| 3 | 1 | 1 | 0 | 0 |
| 4 | 0 | 0 | 1 | 0 |
| 5 | 1 | 0 | 1 | 0 |
| 6 | 0 | 1 | 1 | 0 |
| 7 | 1 | 1 | 1 | 0 |
| 8 | 0 | 0 | 0 | 1 |
| 9 | 1 | 0 | 0 | 1 |
| 10 | 0 | 1 | 0 | 1 |
| 11 | 1 | 1 | 0 | 1 |
| 12 | 0 | 0 | 1 | 1 |
| 13 | 1 | 0 | 1 | 1 |
| 14 | 0 | 1 | 1 | 1 |
| 15 | 1 | 1 | 1 | 1 |

Referring to Table 1, the first pixel P1 may display 16 grayscale values according to a difference between the data voltage and the common voltage that are applied to each of the first, second, third and fourth sub-pixels SP1, SP2, SP3 and SP4, and the corresponding sizes thereof For example, in an exemplary embodiment wherein the first pixel P1 displays a grayscale value of 0, each of the first, second, third and fourth sub-pixels SP1, SP2, SP3 and SP4 receives the data voltage Vdata having a difference, which is maximum, between the data voltage Vdata and the common voltage Vcom, thereby resulting in a black image being displayed by the first pixel P1. That is, the data voltage Vdata has a phase inverted to that of the common voltage Vcom with respect to the reference voltage.

The cholesteric liquid crystal is arranged in the homeotropic state so that each of the first, second, third and fourth sub-pixels SP1, SP2, SP3 and SP4 display the black image. Thus, the first pixel P1 may display a grayscale value of 0.

Additionally, in the exemplary embodiment wherein the first pixel P1 display a grayscale value of 13, each of the first, third and fourth sub-pixels SP1, SP3 and SP4 receives a data voltage Vdata having a phase that is substantially the same as that of the common voltage Vcom. Also, the second sub-pixel SP2 receives a data voltage Vdata having a phase that is inverted to that of the common voltage Vcom. Therefore, the cholesteric liquid crystal that is included in each of the first, third and fourth sub-pixels SP1, SP3 and SP4, is arranged in the planar state, so that each of the first, third and fourth sub-pixels SP1, SP3 and SP4 displays a color image. The cholesteric liquid crystal included in the second sub-pixel SP2, is arranged in the homeotropic state, so that the second sub-pixel SP2 displays the black image. Thus, the first pixel P1 may display a grayscale value of 13.

Therefore, the first, second, third and fourth sub-pixel electrodes SE1, SE2, SE3 and SE4 each either display the black image or the color image, so that 16 grayscale values may be displayed. The color image may include various colors, such as green, red, blue, etc., to be displayed in full color.

As shown FIG. 6, a second pixel P2 adjacent to the first pixel P1 also comprises first, second, third and fourth sub-pixels SP1, SP2, SP3 and SP4. In one exemplary embodiment, the arrangement of the first, second, third and fourth sub-pixels SP1, SP2, SP3 and SP4 of the second pixel P2, may be different from that of the first pixel P1. For example, in the illustrated exemplary embodiment the first data line DL1 is connected to the fourth sub-pixel SP4, the second data line DL2 is connected to the first sub-pixel SP1, the third data line DL3 is connected to the third sub-pixel SP3 and the fourth data line DL4 is connected to the second sub-pixel SP2.

A third pixel P3 adjacent to the second pixel P2 also comprises first, second, third and fourth sub-pixels SP1, SP2, SP3 and SP4. In one exemplary embodiment, the arrangement of the first, second, third and fourth sub-pixels SP1, SP2, SP3 and SP4 of the third pixel P3, may be different from that of the first pixel P1 and the second pixel P2. For example, the first data line DL1 is connected to the second sub-pixel SP2, the second data line DL2 is connected to the third sub-pixel SP3, the third data line DL3 is connected to the first sub-pixel SP1 and the fourth data line DL4 is connected to the fourth sub-pixel SP4.

A fourth pixel P4 adjacent to the third pixel P3 also comprises first, second, third and fourth sub-pixels SP1, SP2, SP3 and SP4. In one exemplary embodiment, the arrangement of the first, second, third and fourth sub-pixels SP1, SP2, SP3 and SP4 of the fourth pixel P4, may be different from that of the first pixel P1, the second pixel P2 and the third pixel P3. For example, in one exemplary embodiment the first data line DL1 is connected to the third sub-pixel SP3, the second data line DL2 is connected to the second sub-pixel SP2, the third data line DL3 is connected to the fourth sub-pixel SP4 and the fourth data line DL4 is connected to the first sub-pixel SP1.

As a result, the first data line DL1 may be connected to the first to fourth sub-pixels SP1, SP2, SP3 and SP4 of the first to fourth pixels P1, P2, P3 and P4, respectively, the second data line DL2 may be connected to the first to fourth sub-pixels SP1, SP2, SP3 and SP4 of the first to fourth pixels P1, P2, P3 and P4, respectively, the third data line DL3 may be connected to the first to fourth sub-pixels SP1, SP2, SP3 and SP4 of the first to fourth pixels P1, P2, P3 and P4, respectively, and the fourth data line DL4 may be connected to the first to fourth sub-pixels SP1, SP2, SP3 and SP4 of the first to fourth pixels P1, P2, P3 and P4, respectively.

In the present exemplary embodiment, the first to fourth sub-pixels SP1, SP2, SP3 and SP4 are electrically connected to one gate line and four data lines. However, the present invention is not to be construed as limited to such an exemplary embodiment. For example, alternative exemplary embodiments include configurations wherein the first to fourth sub-pixels SP1, SP2, SP3 and SP4 may be connected to two gate lines and two data lines. Additional exemplary embodiments include configurations wherein the first to fourth sub-pixels SP1, SP2, SP3 and SP4 may be connected to four gate lines and one data line. Additional exemplary embodiments include configurations wherein the first to fourth sub-pixels SP1, SP2, SP3 and SP4 may be connected to two gate lines and four data lines. Additional alternative exemplary embodiments including other configurations of data lines and gate lines and their connections to the first to fourth sub-pixels are also contemplated.

Figure 7A:
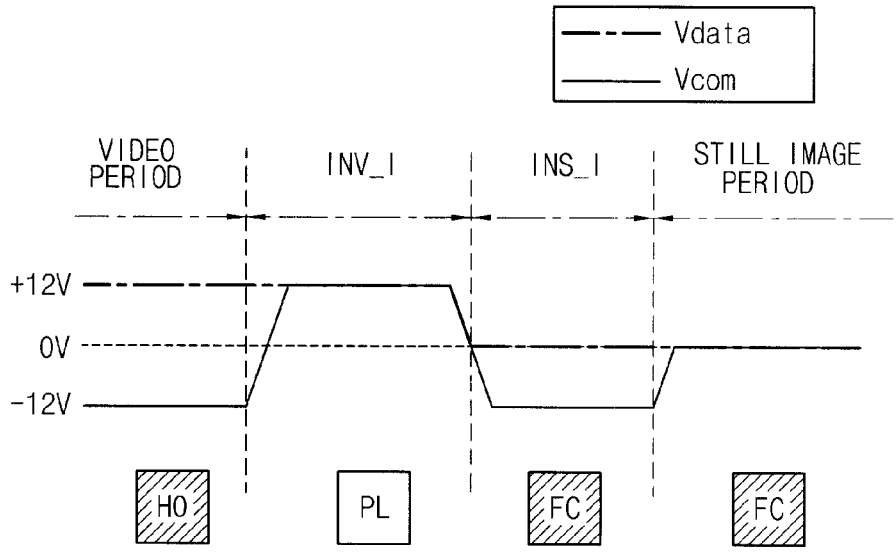
FIGS. 7A and 7B are schematic diagrams illustrating an exemplary embodiment of a method for changing from a video into a still image on the exemplary embodiment of a display apparatus of FIG. 2.
Figure 7B:
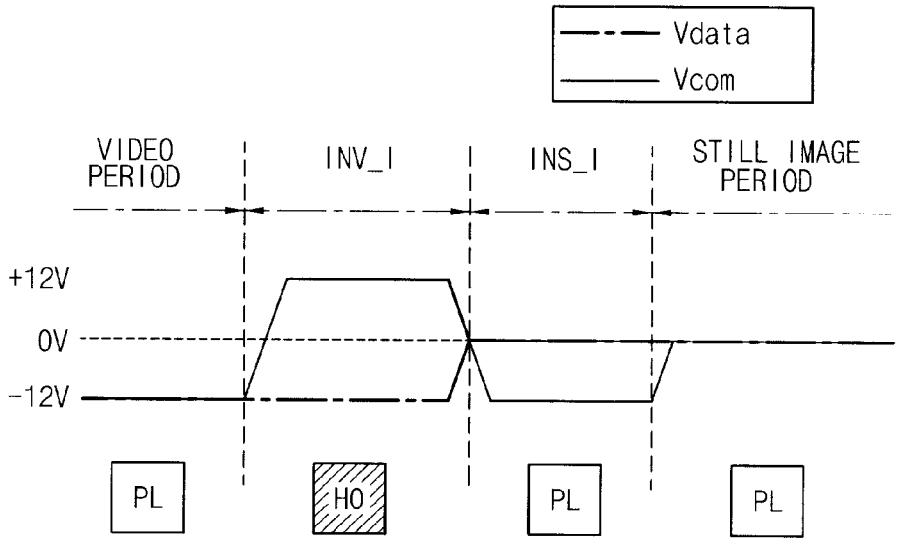

FIGS. 7A and 7B are schematic diagrams illustrating an exemplary embodiment of a method of changing a video into a still image on the exemplary embodiment of a display apparatus of FIG. 2.

An exemplary embodiment of a method of changing a black image of the video into a black image of the still image will be described. Referring to FIGS. 2 and 7A, the pixel receives the common voltage Vcom of the negative polarity (−) and the data voltage Vdata of the positive polarity (+), in a video period. Thus, a difference between the common voltage, e.g., in one exemplary embodiment −12 V, of the negative polarity (−) and the data voltage, e.g., in one exemplary embodiment +12 V, of the positive polarity (+), is a maximum. Therefore, the cholesteric liquid crystal included in the pixel is arranged in the homeotropic state HO, so that the pixel displays the black image.

When the display apparatus receives an interrupt signal for changing the displayed image into the still image, the data driving part 110 applies an inverted voltage for changing the black image into the color image to the pixel in response to the interrupt signal in an inverted period (INV_I).

For example, in the inverted period (INV_I), the pixel receives the common voltage +12 V of the positive polarity (+) according to a frame inversion method. The data driving part 110 applies a data voltage+12 V of the positive polarity (+). Thus, a difference between the common voltage +12 V of the positive polarity (+) and the data voltage +12 V of the positive polarity (+), is a minimum. Therefore, the cholesteric liquid crystal included in the pixel is arranged in the planar state PL, so that the pixel displays the color image.

Subsequently, the data driving part 110 applies a reference voltage Vr to the pixel in a signal period (INS_I). In the present exemplary embodiment, the reference voltage Vr is a middle voltage 0 V between the common voltage +12 V of the positive polarity (+) and the common voltage −12 V of the negative polarity (−). Additionally, in the present exemplary embodiment the reference voltage is a middle voltage 0 V between the data voltage +12 V of the positive polarity (+) and the data voltage −12 V of the negative polarity (−).

The pixel having cholesteric liquid crystal of the planar state PL is driven by the lower potential difference in the signal period (INS_I), so that the cholesteric liquid crystal included in the pixel is arranged in the focal conic state FC. Thus, the pixel displays the black image.

After the signal period (INS_I), the common voltage Vcom and the data voltage Vdata applied to the pixel are blocked in a still image period. Therefore, the pixel displays the black image of the still image.

Hereinafter, an exemplary embodiment of a method of changing a color image of the video into a color image of the still image will be described. Referring to FIGS. 2 and 7B, the pixel receives the common voltage Vcom of the negative polarity (−) and the data voltage Vdata of the negative polarity (−), in the video period. Thus, a difference between the common voltage −12 V of the negative polarity (−) and the data voltage −12 V of the negative polarity (+), is the minimum. Therefore, the cholesteric liquid crystal included in the pixel is arranged in the planar state PL, so that the pixel displays the color image.

When the display apparatus receives the interrupt signal for changing into the still image, the data driving part 110 applies an inverted voltage for changing the color image into the black image in response to the interrupt signal in the inverted period (INV_I).

For example, in one exemplary embodiment in the inverted period (INV_I), the pixel receives the common voltage +12 V of the positive polarity (+) according to a frame inversion method. The data driving part 110 applies a data voltage −12 V of the negative polarity (−) to the pixel. Thus, a difference between the common voltage +12 V of the positive polarity (+) and the data voltage −12 V of the negative polarity (−), is the maximum. Therefore, the cholesteric liquid crystal included in the pixel is arranged in the homeotropic state HO, so that the pixel displays the black image.

Subsequently, the data driving part 110 applies a reference voltage Vr, e.g., in one exemplary embodiment of about 0 V, to the pixel in a signal period (INS_I).

The pixel having cholesteric liquid crystal of the homeotropic state HO is driven by the lower potential difference in the signal period (INS_I), so that the cholesteric liquid crystal included in the pixel is arranged in the planar state PL. Thus, the pixel displays the color image. The color image may include various colors, such as green, red, blue, etc., to be displayed in full color.

After the signal period (INS_I), the common voltage Vcom and the data voltage Vdata applied to the pixel are blocked in a still image period. Therefore, the pixel displays the color image of the still image.

As described above, the inverted period (INV_I) and the signal period (INS_I) are inserted between the video period and the still image period, so that display quality may be improved.

Figure 8:
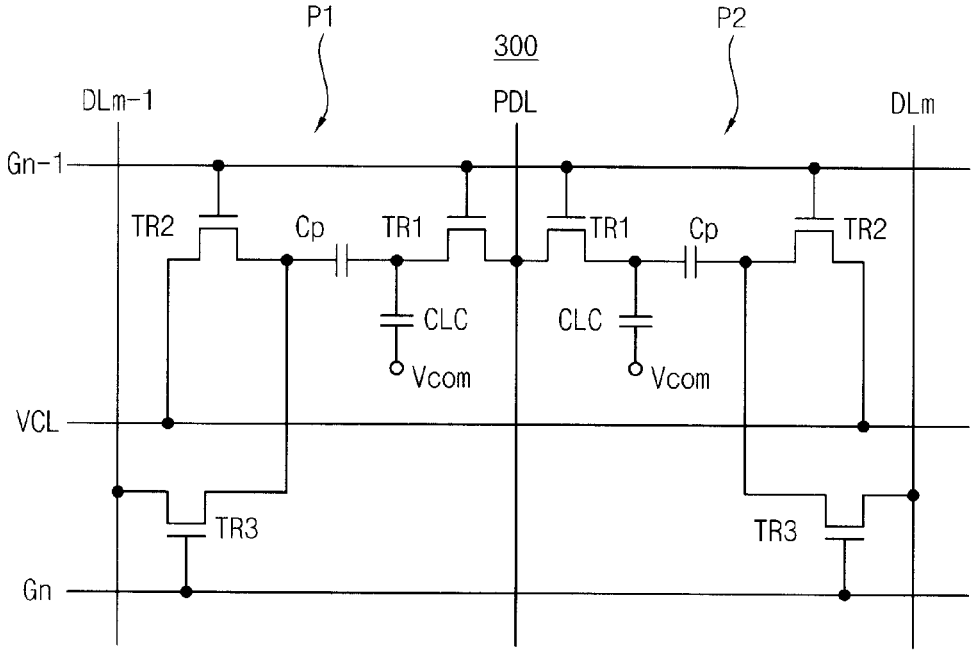
FIG. 8 is an equivalent circuit diagram of a magnified view of another exemplary embodiment of a display panel according to the present invention.

FIG. 8 is an equivalent circuit of another exemplary embodiment of a display panel according to the present invention.

Referring to FIG. 8, the display panel 300 includes a plurality of data lines DLm−1 and DLm, a sub-data line PDL disposed between the data lines DLm−1 and DLm, a plurality of gate lines GLn−1 and GLn disposed substantially perpendicular to the data lines DLm−1 and DLm, a storage line VCL and a plurality of pixels P1 and P2 wherein n and m are natural numbers.

A first pixel P1 includes first, second and third switching elements TR1, TR2 and TR3, a pumping capacitor Cp and a cholesteric liquid crystal capacitor CLC.

The first switching element TR1 includes a control electrode connected to an (n−1)-th gate line GLn−1, an input electrode connected to the sub-data line PDL and an output electrode connected to a first electrode of the cholesteric liquid crystal capacitor CLC. A second electrode of the cholesteric liquid crystal capacitor CLC receives a common voltage Vcom.

The pumping capacitor Cp includes a first electrode connected to the output electrode of the first switching element TR1.

The second switching element TR2 includes a control electrode connected to the (n−1)-th gate line GLn−1, an input electrode connected to the storage line VCL and an output electrode connected to a second electrode of the pumping capacitor Cp. In one exemplary embodiment the storage line VCL may receive the common voltage Vcom.

The third switching element TR3 includes a control electrode connected to an n-th gate line GLn, an input electrode connected to an (m−1)-th data line DLm−1 and an output electrode connected to the second electrode of the pumping capacitor Cp.

When the first and second switching elements TR1 and TR2 are turned on, the pumping capacitor Cp is charged with a voltage based on a sub-data voltage Vpdata applied to the sub-data line PDL. When the third switching element TR3 is turned on, the pumping capacitor Cp increases or decreases a pre-voltage Vpre charged in the cholesteric liquid crystal capacitor CLC based on a data voltage Vdata applied to the (m−1)-th data line DLm−1.

The cholesteric liquid crystal capacitor CLC includes a cholesteric liquid crystal material. When a potential difference between both electrodes of the cholesteric liquid crystal capacitor CLC is a maximum, the cholesteric liquid crystal is arranged in the homeotropic state to display a black image. When the potential difference is a minimum, the cholesteric liquid crystal is arranged in the planar state to display a color image.

An exemplary embodiment of a common electrode (not shown) of the cholesteric liquid crystal capacitor CLC, e.g., the electrode supplying the common voltage Vcom and disposed substantially opposite to the electrode connected to the first transistor TR1, may be formed to include the sub-common electrodes CE1, CE2, . . . , CEn disposed on the opposing substrate as shown in FIG. 4. Alternative exemplary embodiments include configurations wherein the common electrode of the cholesteric liquid crystal capacitor CLC may be formed to one common electrode disposed on the entire area of the opposing substrate.

Figure 9:
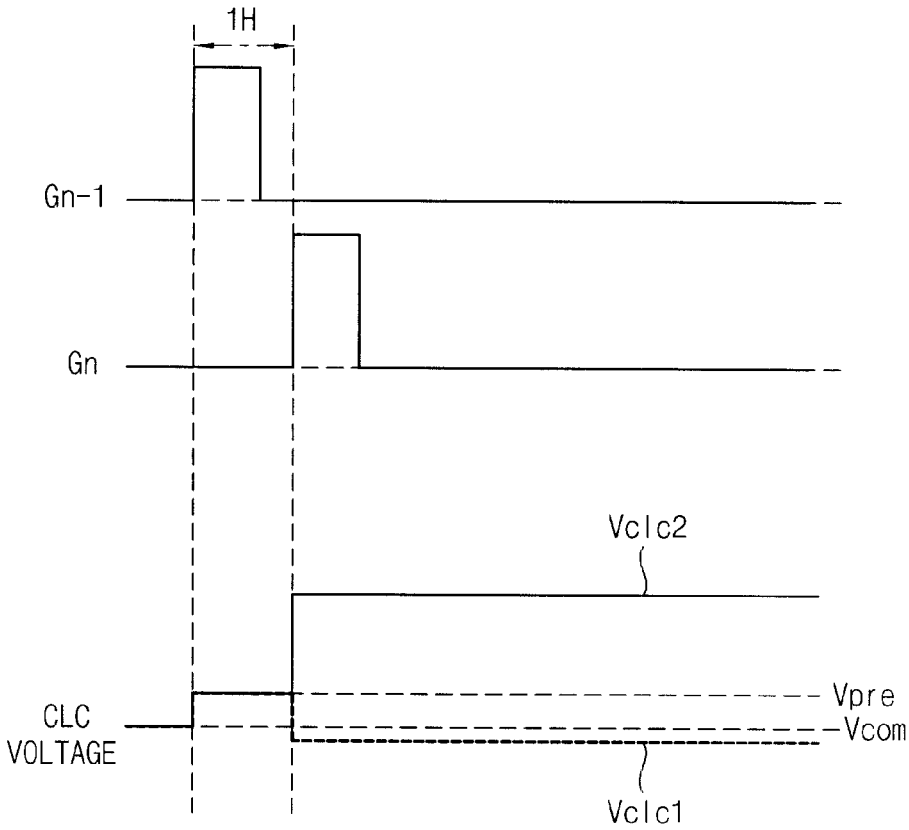
FIG. 9 is a waveform diagram illustrating an exemplary embodiment of a method for driving the display panel of FIG. 8.

FIG. 9 is a waveform diagram illustrating an exemplary embodiment of a method for driving the pixel of FIG. 8;

Referring to FIGS. 8 and 9, an individual sub-data line PDL always receives the sub-data voltage Vpdata of either the positive polarity (+) or the negative polarity (−). Hereinafter, the method for driving the pixel will be explained when the sub-data line PDL always receives the sub-data voltage Vpdata of the positive polarity (+).

For example, in one exemplary embodiment when the (n−1)-th gate line GLn−1 receives an (n−1)-th gate signal Gn−1, the first and second switching elements TR1 and TR2 are turned on. When the first and second switching elements TR1 and TR2 are turned on, the cholesteric liquid crystal capacitor CLC and the pumping capacitor Cp charge the sub-data voltage (Vpdata=+15 V) of the positive polarity (+) applied to the sub-data line PDL. That is, the cholesteric liquid crystal capacitor CLC is charged with the pre-voltage (Vpre=+10 V) from the first switching element TR1 and the second switching element TR2, the pre-voltage corresponding to the sub-data voltage (+15 V).

Subsequently, when the n-th gate line GLn receives an n-th gate signal Gn, the third switching element TR3 is turned on. When the third switching element TR3 is turned on, the data voltage Vdata applied to the (m−1)-th data line DLm−1 is applied to the second electrode of the pumping capacitor Cp.

When the data voltage Vdata is lower than the charged voltage Vcp in the pumping capacitor Cp (Vdata<Vcp), the pumping capacitor Cp decreases the pre-voltage (Vpre=+10 V) charged in the cholesteric liquid crystal capacitor CLC to a first voltage (Vclc1). When the data voltage Vdata is higher than the charged voltage Vcp in the pumping capacitor Cp (Vdata>Vcp), the pumping capacitor Cp increases the pre-voltage (Vpre=+10 V) charged in the cholesteric liquid crystal capacitor CLC to a second voltage (Vclc2). In one exemplary embodiment the first voltage (Vclc1) may be below about 15 V and the second voltage (Vclc2) may be more than about 20 V.

Therefore, when the common voltage Vcom is selected to be a predetermined level, when the cholesteric liquid crystal capacitor CLC is charged with the first voltage (Vclc1), the cholesteric liquid crystal is arranged in the planar state to display the color image. When the cholesteric liquid crystal capacitor CLC is charged with the second voltage (Vclc2), the cholesteric liquid crystal is arranged in the homeotropic state to display the black image.

In one exemplary embodiment, the first pixel P1 comprises the sub-pixels as shown FIG. 6, so that 16 grayscale values may be displayed on the first pixel P1. In such an exemplary embodiment, each of the sub-pixels may include the first, second and third switching elements TR1, TR2 and TR3, the pumping capacitor Cp and the cholesteric liquid crystal capacitor CLC such as included in the equivalent circuit shown in FIG. 8.

Additionally, exemplary embodiments of the display panel 300 may be driven using the exemplary embodiment of a method of changing the video into the still image described with reference to FIGS. 7A and 7B. The inverted period (INV_I) and the signal period (INS_I) are inserted between the video period and the still image period, so that display quality may be improved.

Figure 10:
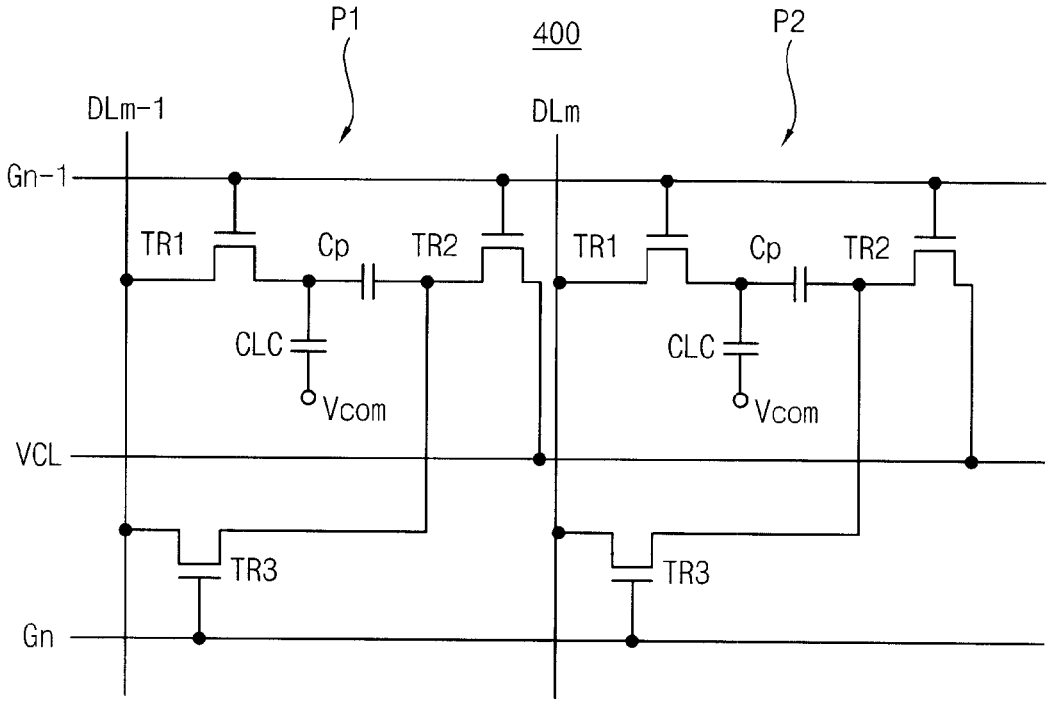
FIG. 10 is an equivalent circuit diagram of a magnified view of another exemplary embodiment of a display panel according the present invention.

FIG. 10 is an equivalent circuit of another exemplary embodiment of a display panel according to the present invention.

Referring to FIG. 10, the display panel 400 includes a plurality of data lines DLm−1 and DLm, a plurality of gate lines GLn−1 and GLn crossing the data lines DLm−1 and DLm, a storage line VCL and a plurality of pixels P1 and P2.

An exemplary embodiment of a first pixel P1 includes first, second and third switching elements TR1, TR2 and TR3, a pumping capacitor Cp and a cholesteric liquid crystal capacitor CLC.

The first switching element TR1 includes a control electrode connected to the (n−1)-th gate line GLn−1, an input electrode connected to the (m−1)-th data line DLm−1 and an output electrode connected to a first electrode of the cholesteric liquid crystal capacitor CLC and a first electrode of the pumping capacitor CP. A second electrode of the cholesteric liquid crystal capacitor CLC receives a common voltage Vcom.

The second switching element TR2 includes a control electrode connected to the (n−1)-th gate line GLn−1, an input electrode connected to the storage line VCL and an output electrode connected to a second electrode of the pumping capacitor Cp. In one exemplary embodiment, the storage line VCL may receive the common voltage Vcom.

The third switching element TR3 includes a control electrode connected to the n-th gate line GLn, an input electrode connected to the (m−1)-th data line DLm−1 and an output electrode connected to the second electrode of the pumping capacitor Cp.

When the first and second switching elements TR1 and TR2 are turned on, the pumping capacitor Cp is charged with a voltage based on a sub-data voltage Vpdata applied to the (m−1)-th data line DLm−1. When the third switching element TR3 is turned on, the pumping capacitor Cp increases or decreases a pre-voltage Vpre charged in the cholesteric liquid crystal capacitor CLC based on a data voltage Vdata applied to the (m−1)-th data line DLm−1, similar to the previously described exemplary embodiment. The (m−1)-th data line DLm−1 receives the sub-data voltage Vpdata and the data voltage Vdata in the 1H.

The cholesteric liquid crystal capacitor CLC includes a cholesteric liquid crystal layer. When a potential difference between both electrodes of the cholesteric liquid crystal capacitor CLC is a maximum, the cholesteric liquid crystal is arranged in the homeotropic state to display a black image. When the potential difference is a minimum, the cholesteric liquid crystal is arranged in the planar state to display a color image.

Exemplary embodiments include configurations wherein a common electrode (not shown) of the cholesteric liquid crystal capacitor CLC may be formed to include the sub-common electrodes CE1, CE2, . . . , CEn disposed on the opposing substrate as shown in FIG. 4. Alternative exemplary embodiments include configurations wherein the common electrode of the cholesteric liquid crystal capacitor CLC may be formed to include one common electrode disposed on the entire area of the opposing substrate.

Figure 11:
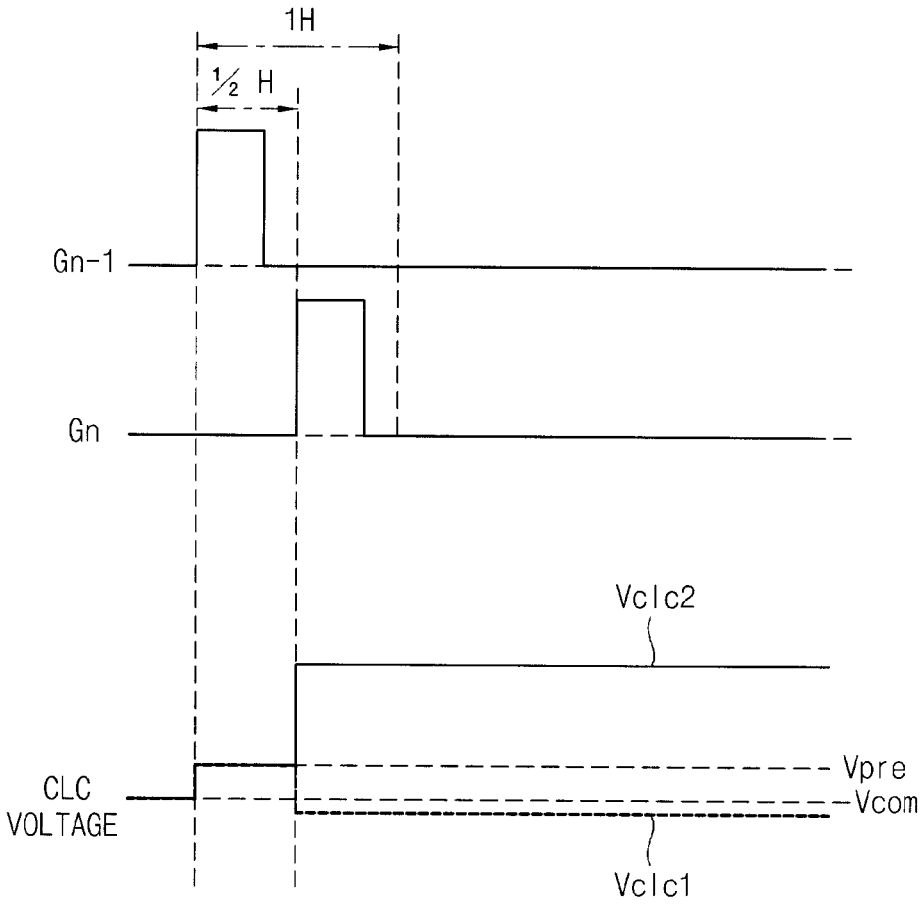
FIG. 11 is a waveform diagram illustrating an exemplary embodiment of a method for driving the display panel of FIG. 8.

FIG. 11 is a waveform diagram illustrating an exemplary embodiment of a method for driving the pixel of FIG. 8.

Referring to FIGS. 10 and 11, when the (n−1)-th gate line GLn−1 receives an (n−1)-th gate signal Gn−1, the first and second switching elements TR1 and TR2 are turned on. When the first and second switching elements TR1 and TR2 are turned on, the cholesteric liquid crystal capacitor CLC and the pumping capacitor Cp charge the sub-data voltage (Vpdata=+15 V) of the positive polarity (+) applied to the (m−1)-th data line DLm−1. That is, the cholesteric liquid crystal capacitor CLC is charged with the pre-voltage (Vpre=+10 V) corresponding to the sub-data voltage (+15 V). The (n−1)-th gate signal Gn−1 has a pulse width corresponding to about ½ a horizontal period.

Subsequently, when the n-th gate line GLn receives an n-th gate signal Gn, the third switching element TR3 is turned on. When the third switching element TR3 is turned on, the data voltage Vdata applied to the (m−1)-th data line DLm−1 is applied to the second electrode of the pumping capacitor Cp. In the present exemplary embodiment the n-th gate signal Gn has a pulse width corresponding to about ½ horizontal period. The (m−1)-th data line DLm−1 receives the sub-data voltage Vpdata in an initial ½ horizontal period and the data voltage Vdata in a latter ½ horizontal period.

When the data voltage Vdata is lower than the charged voltage Vcp in the pumping capacitor Cp (Vdata<Vcp), the pumping capacitor Cp decreases the pre-voltage (Vpre=+10 V) charged in the cholesteric liquid crystal capacitor CLC to a first voltage (Vclc1). When the data voltage Vdata is higher than the charged voltage Vcp in the pumping capacitor Cp (Vdata>Vcp), the pumping capacitor Cp increases the pre-voltage (Vpre=+10 V) charged in the cholesteric liquid crystal capacitor CLC to a second voltage (Vclc2). In one exemplary embodiment, the first voltage (Vclc1) may be below 15 V and the second voltage (Vclc2) may be more than 20 V.

Therefore, when the cholesteric liquid crystal capacitor CLC is charged with the first voltage (Vclc1), the cholesteric liquid crystal is arranged in the planar state to display the color image. When the cholesteric liquid crystal capacitor CLC is charged with the second voltage (Vclc2), the cholesteric liquid crystal is arranged in the homeotropic state to display the black image.

In one exemplary embodiment, the first pixel P1 comprises the sub-pixels as shown FIG. 6, so that 16 grayscale values may be displayed on the first pixel P1. In such an exemplary embodiment, each of the sub-pixels may include the first, second and third switching elements TR1, TR2 and TR3, the pumping capacitor Cp and the cholesteric liquid crystal capacitor CLC such as the equivalent circuit shown in FIG. 8.

Additionally, the display panel 400 may be driven using the exemplary embodiment of a method of changing the video into the still image described with reference to FIGS. 7A and 7B. The inverted period (INV_I) and the signal period (INS_I) are inserted between the video period and the still image period, so that display quality may be improved.

According to the present invention, a video may be displayed using a homeotropic state and a planar state of cholesteric liquid crystal. Additionally, a still image may be displayed using the planar state and a focal conic state of the cholesteric liquid crystal. The cholesteric liquid crystal display (LCD) has substantially the same characteristics as a reflective LCD. Therefore, exemplary embodiments of the cholesteric LCD may omit a color filter, a polarizer and a backlight unit employed in the typical reflective LCD, and thus costs may be reduced.

The foregoing is illustrative of the present invention and is not to be construed as limiting thereof Although a few exemplary embodiments of the present invention have been described, those skilled in the art will readily appreciate that many modifications are possible in the example embodiments without materially departing from the novel teachings and advantages of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific example embodiments disclosed, and that modifications to the disclosed example embodiments, as well as other example embodiments, are intended to be included within the scope of the appended claims. The present invention is defined by the following claims, with equivalents of the claims to be included therein.

What is claimed is:

1. A method for driving a display panel, the display panel including a plurality of pixels, each of the plurality of pixels including a cholesteric liquid crystal capacitor, the method comprising:

applying a common voltage to the display panel; and displaying a video on the display panel by applying a data voltage to at least one of the plurality of pixels, the data voltage having a phase which is one of inverted to and substantially the same as a phase of the common voltage with respect to a reference voltage, wherein the displaying a video on the display panel further comprises:

sequentially applying a plurality of gate signals to a plurality of gate lines, the plurality of gate lines being disposed on the display panel;

applying the data voltage having the phase which is one of inverted to the phase of the common voltage to at least one of a plurality of data lines disposed on the display panel to display a black image in a first frame; and applying the data voltage having the phase which is substantially the same as the phase of the common voltage to the at least one of a plurality of data lines disposed on the display panel, to display a color image in a second frame subsequent to the first frame.

2. The method of claim 1, wherein the applying a common voltage to the display panel includes sequentially applying a plurality of common voltages to the display panel, the application of the plurality of common voltages being synchronized with the application of the plurality of gate signals.

3. The method of claim 2, wherein the phase of the common voltage is inverted after a frame period.

4. The method of claim 1, further comprising changing the video into a still image, wherein the video is changed into the still image by:

applying the data voltage having the phase substantially the same as the phase of the common voltage to a first pixel which displays a black image of the video, and applying the data voltage having the phase inverted to the phase of the common voltage to a second pixel which displays a color image of the video, during an inverted period; and applying the reference voltage to the first pixel and the second pixel during a signal period, so that the first pixel displays the black image and the second pixel displays the color image.

5. The method of claim 4, further comprising:

blocking voltages applied to the display panel after the signal period.

6. The method of claim 4, wherein each of the inverted period and the signal period corresponds to a single frame period.

7. A display apparatus comprising:

a display panel including a plurality of pixels, each of the plurality of pixels including a cholesteric liquid crystal capacitor; and a panel driving part which applies a common voltage to the display panel, and displays a video on the display panel by application of a data voltage to at least one of the plurality of pixels, the data voltage having a phase which is inverted a phase of the common voltage with respect to a reference voltage in a first frame, and the data voltage having a phase which is substantially the same as the phase of the common voltage with respect to the reference voltage in a second frame subsequent to the first frame.

8. The display apparatus of claim 7, wherein the display panel comprises:

a display substrate comprising:

a switching element;

a data line electrically connected to the switching element;

a gate line disposed substantially parallel to the data line; and a pixel electrode which forms a part of the cholesteric liquid crystal capacitor and is electrically connected to the switching element;

a opposing substrate comprising:

a plurality of sub-common electrodes, wherein each of the sub-common electrodes extend substantially parallel with the gate line and which forms a part of the cholesteric liquid crystal capacitor substantially opposite the pixel electrode; and a cholesteric liquid crystal layer disposed between the display substrate and the opposing substrate.

9. The display apparatus of claim 8, wherein the panel driving part comprises:

a data driving part which applies the data voltage to the pixel electrode of the cholesteric liquid crystal capacitor via the data line;

a gate driving part which controls an operation of the switching element by an application of a gate signal to the gate line; and a common voltage driving part which applies the common voltage to the plurality of sub-common electrodes, wherein the application of the common voltage to the plurality of sub-common electrodes is synchronized with the application of the gate signal to the gate line.

10. The display apparatus of claim 9, wherein the common voltage driving part reverses the phase of the common voltage with respect to the reference voltage after a frame period.

11. The display apparatus of claim 7, wherein each of the plurality of pixels comprises a plurality of sub-pixels, each of the plurality of sub-pixels having at least one sub-pixel electrode, and wherein sizes of the sub-pixel electrodes corresponding to at least two sub-pixels of the plurality of sub-pixels are different from each other.

12. The display apparatus of claim 11, wherein each of the plurality of pixels comprises:

a first sub-pixel including a first sub-pixel electrode having a first size;

a second sub-pixel including a second sub-pixel electrode having a second size larger than the first size;

a third sub-pixel including a third sub-pixel electrode having a third size larger than the second size; and a fourth sub-pixel including a fourth sub-pixel electrode having a fourth size larger than the third size, wherein a ratio of the first, second, third and fourth sizes is about 1:2:4:8.

13. The display apparatus of claim 7, wherein at least one of the plurality of pixels comprises:

a first switching element connected to an (n−1)-th gate line, a sub-data line and the cholesteric liquid crystal capacitor;

a second switching element connected to the (n−1)-th gate line and a storage line;

a pumping capacitor including a first electrode connected to an output electrode of the first switching element and a second electrode connected to an input electrode of the second switching element; and a third switching element connected to the n-th gate line, an (m−1)-th data line and the second electrode of the pumping capacitor, wherein n and m are natural numbers.

14. The display apparatus of claim 13, wherein the sub-data line is disposed between the (m−1)-th data line and an m-th data line, and the panel driving part applies a sub-data voltage to the sub-data line.

15. The display apparatus of claim 7, wherein at least one of the plurality of pixels comprises:

a first switching element connected to an (n−1)-th gate line, an (m−1)-th data line and the cholesteric liquid crystal capacitor;

a second switching element connected to the (n−1)-th gate line and a storage line;

a pumping capacitor including:

a first electrode connected to an output electrode of the first switching element; and a second electrode connected to an input electrode of the second switching element; and a third switching element connected to the n-th gate line, an (m−1)-th data line and the second electrode of the pumping capacitor, wherein n and m are natural numbers.

16. The display apparatus of claim 15, wherein the panel driving part applies a sub-data voltage to the (m−1)-th data line during an initial ½ horizontal period and applies the data voltage to the (m−1)-th data line during a ½ horizontal period immediately subsequent to the initial ½ horizontal period.

17. The display apparatus of claim 7, wherein the video is changed into a still image, and the panel driving part applies the data voltage having the phase substantially the same as the phase of the common voltage with respect to the reference voltage to a first pixel which displays a black image of the video and applies the data voltage having the phase inverted to the phase of the common voltage with respect to the reference voltage to a second pixel which displays a color image of the video, during an inverted period, and applies the reference voltage to the first pixel and the second pixel during a signal period so that the first pixel displays the black image and the second pixel displays the color image during a time period when the video is changed into the still image.

18. The display apparatus of claim 17, wherein the panel driving part blocks voltages applied to the display panel after the signal period.

19. The display apparatus of claim 17, wherein each of the inverted period and the signal period correspond to a single frame period.

* * * * *